US007334421B1

(12) United States Patent
Cantolino

(10) Patent No.: US 7,334,421 B1
(45) Date of Patent: Feb. 26, 2008

(54) AIR CONDITIONER PAD

(76) Inventor: Christopher Ralph Cantolino, 2424 Manatee Ave., W., Suite 210, Bradenton, FL (US) 34205

( * ) Notice: Subject to any disclaimer, the term of this patent is extended or adjusted under 35 U.S.C. 154(b) by 289 days.

(21) Appl. No.: 11/252,280

(22) Filed: Oct. 17, 2005

(51) Int. Cl.
*F25D 23/12* (2006.01)
*F25D 19/00* (2006.01)
*F15M 1/00* (2006.01)

(52) U.S. Cl. ..... 62/259.1; 62/298; 248/678

(58) Field of Classification Search ..... 62/259.1, 62/285, 291, 295, 297, 298, 507, 508; 165/67; 248/676, 678; 312/351.7
See application file for complete search history.

(56) References Cited

U.S. PATENT DOCUMENTS 5,697,227 A * 12/1997 Bruce et al. ..... 62/285
5,732,565 A * 3/1998 Ramakrishnan et al. ..... 62/298
6,099,267 A * 8/2000 Ames et al. ..... 417/360
6,301,914 B1 * 10/2001 Oliva et al. ..... 62/262
6,651,454 B1 * 11/2003 Spiegel ..... 62/259.1
6,705,105 B2 * 3/2004 Wendt et al. ..... 62/298
6,938,356 B2 * 9/2005 Nagae et al. ..... 34/77
7,055,582 B2 * 6/2006 Erisgen ..... 165/122
D539,888 S * 4/2007 Tsuji ..... D23/351
7,263,853 B2 * 9/2007 Zizas ..... 62/344
7,266,956 B2 * 9/2007 Norrell et al. ..... 62/125
7,269,965 B2 * 9/2007 Kim et al. ..... 62/259.2
2003/0217563 A1 * 11/2003 Wendt et al. ..... 62/298

FOREIGN PATENT DOCUMENTS

JP 2002-21734 A * 1/2002

* cited by examiner

*Primary Examiner*—Mohammad M. Ali
(74) *Attorney, Agent, or Firm*—Dorothy S. Morse

(57) ABSTRACT

An air conditioning pad that is to be placed under an air conditioning unit to support it, raise it off the ground, and maintain it in a preferred position of use, even when subjected to strong winds or flooding. It has a plurality of openings therethrough for the insertion of tie-down straps, several central supports to give it strength, and has at least one interior cavity that can be filled with fluid or other material on site to provide the weight needed to meet new building code requirements relating to severe storm conditions and/or otherwise maintain an air conditioning unit in its originally selected position of use. Applications include, but are not limited to, use in supporting air conditioning units in outside locations.

20 Claims, 4 Drawing Sheets

AIR CONDITIONER PAD

CROSS-REFERENCES TO RELATED APPLICATIONS

None.

BACKGROUND

1. Field of the Invention

This invention relates to ground supports used for air conditioning units, specifically to an air conditioning pad that is to be placed under an air conditioning unit to support it, raise it off the ground, and maintain it in a preferred position of use, even when subjected to strong winds. It has a plurality of openings therethrough for the insertion of tie-down straps, several central supports to give it strength, and has at least one interior cavity that can be filled with fluid or other material on site to provide the weight needed to meet new building code requirements relating to severe storm conditions and/or otherwise maintain an air conditioning unit in its originally selected position of use. Applications include, but are not limited to, use in supporting air conditioning units in outside locations.

2. Description of the Related Art

Outside air conditioning units are typically placed upon pads or other supports that raise them off of the ground and provide a substantially level surface for their operation. Having the air conditioner above ground level, even if raised above ground level by only a few inches, protects the air conditioning unit from damage due to local flooding and ground moisture that could rust out the bottom surface of the unit over time, and makes it less likely to be adversely impacted by insects and small animals. Further, new building code requirements in some areas affected by severe weather conditions dictate that newly installed air conditioning units be secured by tie-down straps connected to a heavy object having specified minimum weight requirements. Prior air conditioning supports include cement slabs poured on site, which are expensive to install, although rings or cleats can be provided in new construction for tie-down attachment. Pre-poured cement slabs or blocks are heavy to transport to an air conditioner installation site, and are subject to breakage and cracking during such transport and installation. Prior art air conditioning supports made from plastic are generally lightweight for easy transport to an air conditioner installation site. However, they do not meet the new building code requirements set in place to protect air conditioning units from the adverse effects of severe storms. In contrast, the present invention was designed to meet the new building code requirements and maintain an air conditioning unit above ground level a sufficient amount to protect it from local flooding, as well as secure it and maintain it in a normal position of use even when subjected to strong winds. No other apparatus or method is known that functions in the same manner or provides all of the advantages of the present invention.

BRIEF SUMMARY OF THE INVENTION

It is the primary object of this invention to provide a support pad for an air conditioning unit that provides tie-down capability to maintain the air conditioning unit in place even when it is subjected to severe weather conditions having strong winds. It is also an object of this invention to provide a support pad for an air conditioning unit that is lightweight for easy transport to an installation site, yet meets new tie-down requirements. A further object of this invention is to provide a support pad for an air conditioning unit that has a reinforced design for long-term use without any sagging or other adverse change in configuration. It is also an object of this invention to provide a support pad for an air conditioning unit that is made from durable materials that are protected from premature deterioration from weathering effects, including UV light exposure. It is a further object of this invention to provide a support pad for an air conditioning unit that is sufficient in size for use with a variety of sizes of air conditioning units currently in use. Another object of this invention is to provide a support pad for an air conditioning unit that has durable construction, requires little refurbishment between uses, and is cost effective to use. It is also an object of this invention to provide a support pad for an air conditioning unit that has a safety option to prevent fluid overfill.

The present invention, when properly made and used, will provide a support pad for an air conditioning unit that has perimeter tie-down openings to use with tie-down straps placed over the air conditioning unit to maintain it in place even when subjected to severe weather conditions and strong winds. Cut-out areas around the tie-down openings make them convenient to use. The support pad is preferably made from unitary construction, with the exception of removable seals for fill/vent/drain openings. It is also preferably made from lightweight molded plastic so that it is easy to transport to an installation site, and also easy to lift and place in a preferred position of use. Although not limited thereto, it preferably has a minimum thickness dimension of approximately four inches to raise the supported air conditioning unit off of the ground and protect it against local flooding, while meeting local building code requirements. This raises the supported air conditioning unit higher than most of the commonly used prior art pads. Also, although it preferably has minimum length and width dimensions of approximately thirty to forty inches so that it is sufficient in size for use with a variety of sizes of air conditioning units currently in use, several embodiment of differing size are also contemplated for use. Central reinforcements provide the needed support for an air conditioning unit without any sagging or other adverse change in configuration during its term of use. Also, its durable construction requires little maintenance or refurbishment during use. Although not critical, it is further contemplated that the present invention pad be made for long-term use from materials that are protected from premature deterioration from weathering effects, including UV light exposure. The hollow interior chamber of the present invention support pad and conveniently located main fill/vent/drain opening allows it to be easily filled with any fluid available in generous supply at the installation site, as long as that fluid does not adversely affect the materials used for pad construction so as to cause it to undergo premature deterioration and/or collapse. Using a fluid such as water makes it easy to drain when the pad is no longer needed for use and must be removed from the installation site. An optional maximum fluid fill-line can be identified so as to allow expansion in colder climates where freezing is a concern. In the alternative, an opening at the maximum desired fluid level can prevent over-fill. However, other fill materials, such as but not limited to sand and other granular materials, can also be used to meet the minimum weight requirement of local building codes for wind resistance and to prevent transport away from its preferred location as a result of flooding. Optional drain and vent openings may also be used to facilitate and speed up the filling and draining processes.

The description herein provides preferred embodiments of the present invention but should not be construed as limiting its scope. For example, variations in the number, size and positioning of tie-down openings used; the materials used for the main body of the support pad; the configuration, size, number, and positioning of central supports in the main body of the support pad; the size and location of the main fill/vent/drain opening, the shape of the corners of the main body of the support pad; the optional use of addition holes through the main body of the support pad for venting and draining purposes; the thickness dimension of the main body of the support pad and the type of seal used on the main fill/vent/drain opening, other than those shown and described herein, may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 5:
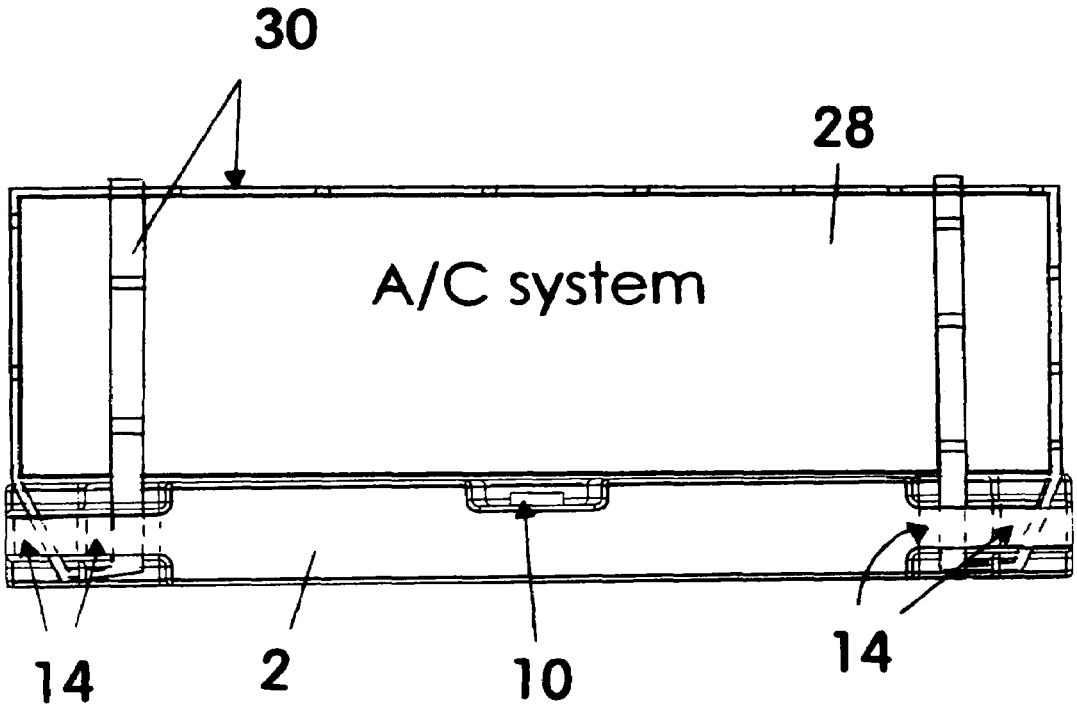
FIG. 5 is a side view of the most preferred embodiment of the present invention supporting an air conditioning unit, with tie-down straps securing the air conditioning unit to the present invention.

The present invention provides a support pad 2 for an air conditioning unit (identified in FIG. 5 by the number 28. Support pad 2 has a main body 4 with a hollow interior chamber (identified by the number 34 in FIG. 2) that can be filled with fluid 36 or granular material (not shown) readily available at an installation site to make it sufficiently heavy to use as an anchor to protect the air conditioning unit 28 from movement away from its intended position of use due to adverse weather conditions, such as strong wind or flooding. The present invention support pad 2 also has perimeter tie-down openings 14 to use with tie-down straps (identified by the number 30 in FIG. 5) placed over air conditioning unit 28 to hold it in place after installation. Cut-out areas 12 below tie-down openings 14 provide clearance for tie-down straps 30 so that they do not extend below the bottom plane of main body 4 and are not subject to contact with the ground surface upon which main body 4 is typically placed. Similarly, cut-out areas 12 above tie-down openings 14 provide clearance for tie-down straps 30 so that they can be angled around main body 4 without undue tension that could lead to premature failure. Support pad 2 is preferably made from unitary construction and lightweight molded plastic so that it is easy to transport to an installation site, and also easy to lift and place in a preferred position of use. Although not limited thereto, it preferably has a minimum thickness dimension of approximately four inches to raise the supported air conditioning unit 28 off the ground and protect it against local flooding, while meeting local building code requirements. Also, support pad 2 preferably has minimum length and width dimensions of approximately thirty inches so that it is sufficient in size for use with a variety of sizes of air conditioning units 28 currently in use. Central reinforcements 18 in support pad 2 provide the needed support for an air conditioning unit 28 without any sagging or other adverse change in configuration during its term of use. Although the top end of central reinforcements 18 are typically open, it is preferred for their bottom ends to be closed to prevent moisture from the ground from affecting the bottom surface of air conditioning unit 28 and causing its premature deterioration. Further, support pad 2 has a large opening 10, used for fill/vent/drain purposes, and may also optionally have additional drain or vent openings to speed up the drain process. A fill line 26 may also be incorporated into main body 4 to ensure that an expansion space (identified in FIG. 2 by the number 38) will remain when support pad 2 is installed in colder climates subject to freezing temperatures.

Figure 1:
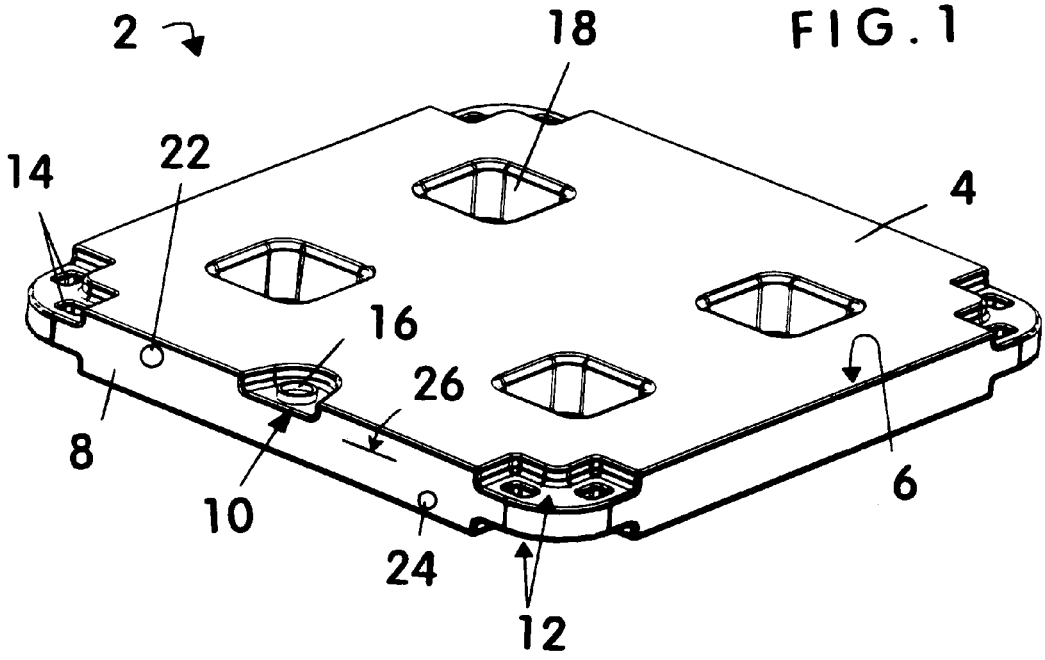
FIG. 1 is a perspective view of the most preferred embodiment of the present invention having a plurality of corner openings therethrough for the insertion of tie-down straps, several central supports to give it strength, a main fill/drain/vent opening, optional vent and drain openings, and has at least one interior cavity that can be filled with fluid or other material on site to provide the weight needed to meet new building code requirements relating to severe storm conditions and/or otherwise maintain an air conditioning unit in its originally selected position of use.
Figure 2:
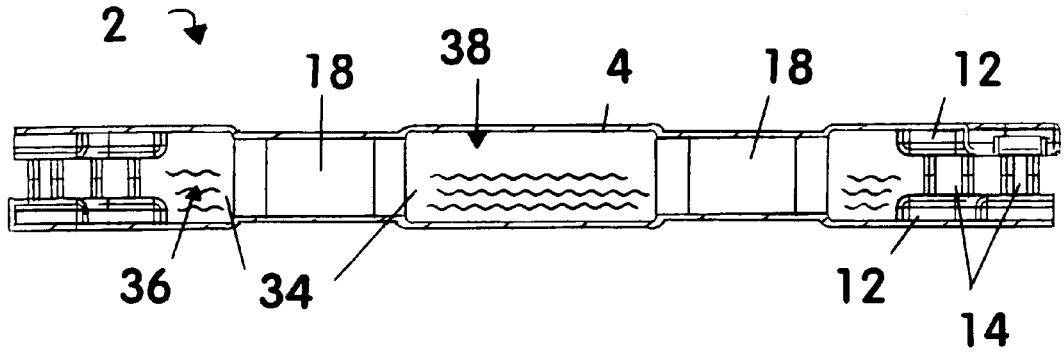
FIG. 2 is a side sectional view of the most preferred embodiment of the present invention.
Figure 3:
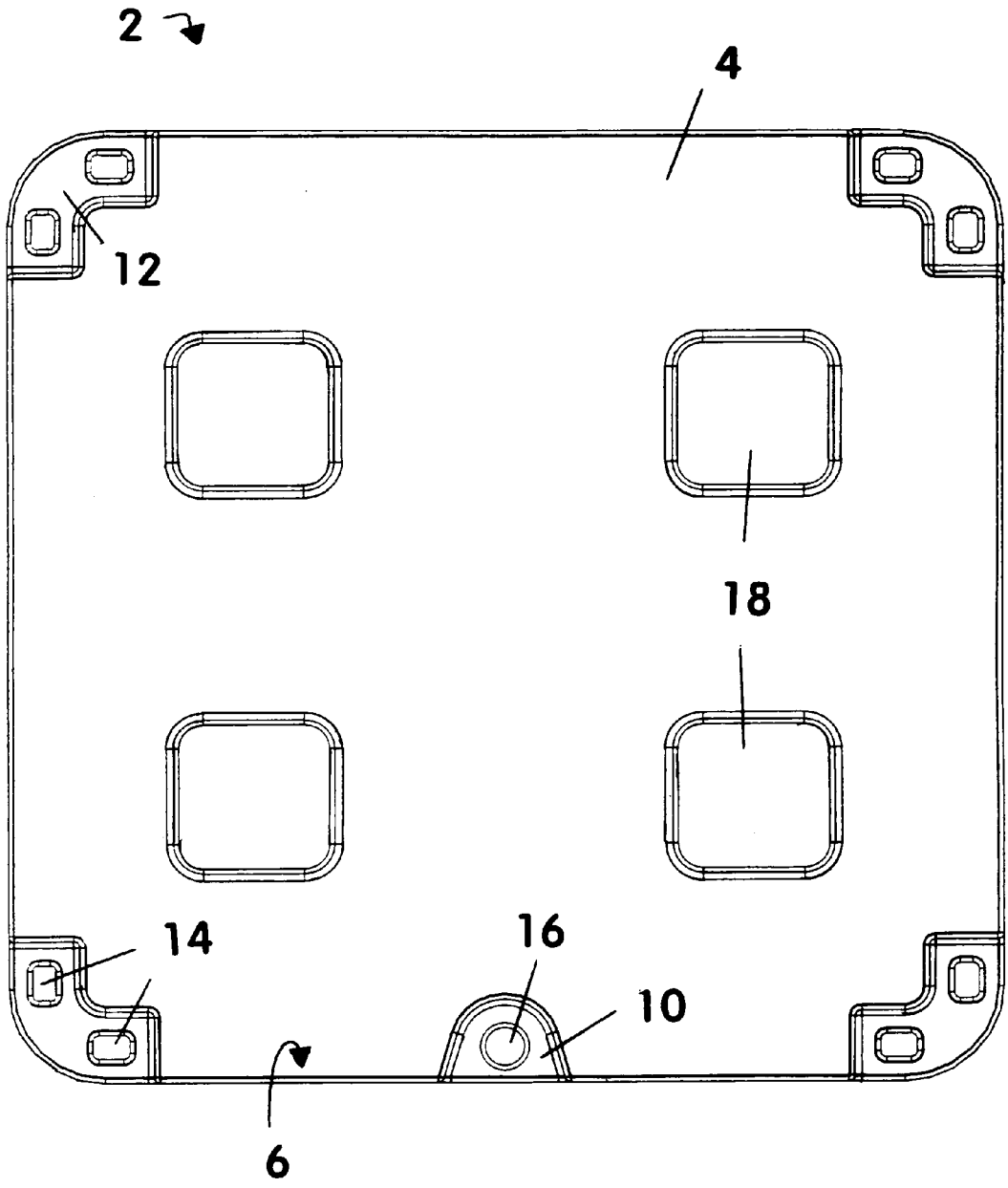
FIG. 3 is a top view of the most preferred embodiment of the present invention.
Figure 4:
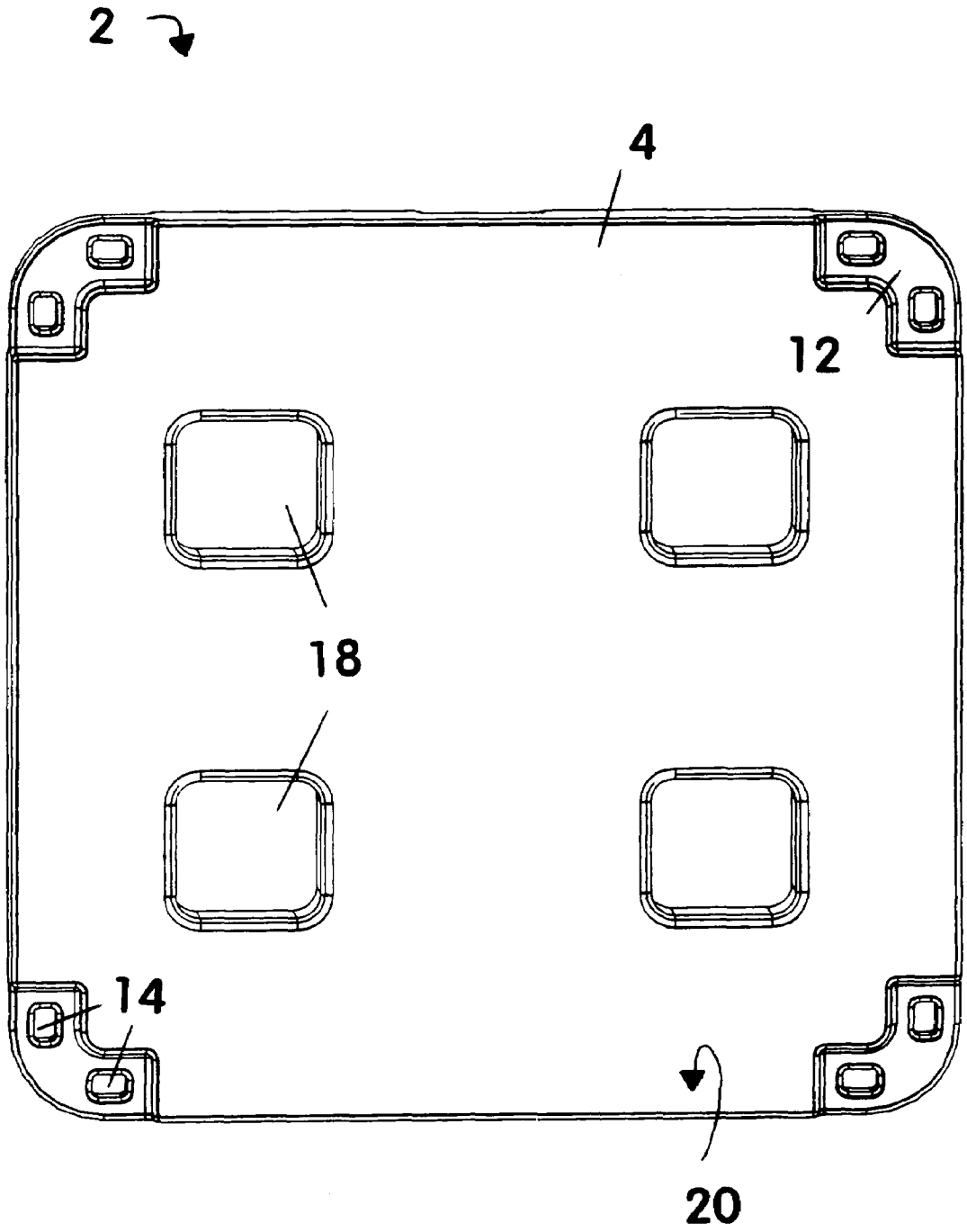
FIG. 4 is a bottom view of the most preferred embodiment of the present invention.

FIGS. 1, 3 and 4 show support pad 2 having a generally rectangular configuration, rounded corners, cutouts 12 and tie-down openings 14 in corner locations, two tie-down openings 14 associated with each cutout 12, fill/vent/drain opening 10 centrally positioned along one side of the top surface of main body 4, and four central supports 18 each having a substantially rectangular configuration. The rounded shape of the corners of main body 4 is not critical, and may be chamfered or have another configuration other than that depicted in FIGS. 1, 3, and 4. Although not shown, it is contemplated for central supports 18 to be sealed on one end, so as not to allow moisture from the ground (not shown) to adversely affect the supported air conditioning unit 28. The number and location of cutouts 12, tie-down openings 14, fill/vent/drain openings 10 and central supports 18 are not critical as long each allows easy long-term use of support pad 2. The configuration and size of central supports 18 in the main body 4 of support pad 2 is also subject to variability, as long as construction durability is not compromised in any way. FIG. 1 shows two other openings in main body 4, a drain opening 24 and a vent opening 22. It should be noted that although not shown, two or more fill/vent/drain openings 10 could be used through main body 4, and multiple drain openings 24 and vent openings 22 could also be used. Optional drain openings 24 and optional vent openings 22 facilitate and speed up the filling and draining of support pad 2. The type of seal (not shown) used over the main fill/vent/drain openings 10, drain openings 24, and vent openings 22, are not critical and can have any configuration or operation that allows it to effectively fulfill its intended function, including but not limited to snap-on, threaded, tethered, and/or hinged. FIG. 2 shows the hollow interior chamber 34 within main body 4, that may be filled with any fluid 36 or other material available at or transported to an installation site, even though it is contemplated that tap water would be used due to its inexpensive cost and wide availability. FIG. 3 shows that there is no additional ridge or other feature within reinforcement structures 18, although it is considered within the scope of the present invention for the bore through reinforcement structures 18 to be sealed to prevent ground moisture from rusting out the bottom of air conditioning unit in moist climates. FIG. 4 shows that the bottom surface 20 of support pad 2 has no other features beyond those disclosed in FIGS. 1 and 3. In addition, FIG. 5 shows an air conditioning unit 28 positioned atop support pad 2, with tie-down straps 30 secured over air conditioning unit 28 and attached to support pad 2 via corner tie-down openings 14, and air conditioning unit 28 substantially covering support pad 2. Thus, the scope of the present invention should be determined by the appended claims and their legal equivalents, rather than being limited to the examples given.

The durable construction of support pad 4 requires little maintenance or refurbishment during use. Although not critical, it is further contemplated for the present invention support pad 2 to be made for long-term use from materials that are protected from premature deterioration from weathering effects, including UV light exposure. The hollow interior chamber 34 of the present invention support pad and conveniently located main fill/vent/drain opening 10 allows it to be easily filled with any fluid 36 available in generous supply at an installation site, as long as that fluid 36 does not adversely affect the materials used for pad 2 construction so as to cause it to undergo premature deterioration and/or collapse. Using a fluid 36, such as water, makes it easy to drain support pad 2 when it is no longer needed for use or must be removed from the installation site. However, other fill materials (not shown), such as but not limited to sand and other granular materials, can also be used to meet the minimum weight requirement of local building codes for wind resistance and to prevent transport away from its preferred location as a result of flooding.

What is claimed is:

1. A pad for use in supporting an air conditioning unit, raising it off the ground, and maintaining it in a preferred position of use even when subjected to strong winds, said pad comprising a main body with an hollow interior chamber, at least one opening adapted for fill/vent/drain purposes, at least one central structural support, and a plurality of tie-down openings so that when an air conditioning unit sits atop said pad and substantially covers it, and said pad is filled with fluid or other material, said pad is able to maintain the air conditioner in its preferred position of use even when subjected to strong winds.

2. The pad of claim 1 wherein said main body has a vertically extending surface and further wherein said at least one opening adapted for fill/vent/drain purposes comprises a main fill/vent/drain opening and a secondary vent opening through said vertically extending surface.

3. The pad of claim 2 wherein said at least one opening adapted for fill/vent/drain purposes further comprises a secondary drain opening through said vertically extending surface.

4. The pad of claim 1 wherein said wherein said main body has a vertically extending surface and further wherein said at least one opening adapted for fill/vent/drain purposes comprises a main fill/vent/drain opening and a secondary drain opening through said vertically extending surface.

5. The pad of claim 1 further comprising overfill protection means adapted for leaving a void within said hollow interior chamber that can be used for fluid expansion when said pad is subjected to temperature extremes.

6. The pad of claim 4 wherein said overfill protection means is selected from a group consisting of a fill line on said main body and a drain/vent opening located through said main body in a position to prevent overfill.

7. The pad of claim 1 wherein said at least one central structural support is configured so that ground moisture is not permitted to reach an air conditioning unit positioned atop said pad when said pad is placed upon the ground.

8. The pad of claim 1 further comprising at least one cutout area associated with each of said tie-down openings.

9. The pad of claim 7 wherein said main body has a substantially rectangular configuration with corners, and at least some of said tie-down openings are located in said corners.

10. The pad of claim 1 further comprising at least one cutout area associated with said at least one opening adapted for fill/vent/drain purposes.

11. A method of supporting an air conditioning unit, raising it off the ground, and maintaining it in a preferred position of use even when subjected to strong winds, said method comprising the steps of:

providing a pad with a main body having an hollow interior chamber, at least one opening adapted for fill/vent/drain purposes, at least one central structural support, and a plurality of tie-down openings;

also providing an air conditioning unit, fill means, and at least one tie-down strap;

placing said pad in a preferred position of use;

adding said fill means to said pad via said at least one opening adapted for fill/vent/drain purposes;

placing said air conditioning unit atop said pad so that said air conditioning unit substantially covers said pad; and inserting said at least one tie-down strap through a plurality of said tie-down openings in said pad and over said air conditioning unit whereby said pad is able to maintain the air conditioner in said preferred position of use even when subjected to strong winds.

12. The method of claim 11 wherein said step of adding said fill means to said pad and placing said air conditioning unit atop said pad are interchangeable.

13. The method of claim 11 wherein said main body has a substantially rectangular configuration with corners, and at least some of said tie-down openings are located in said corners.

14. The method of claim 11 further comprising at least one cutout area selected from a group consisting of cutout areas associated with said tie-down openings and cutout areas associated said fill/vent/drain openings.

15. The method of claim 11 wherein said at least one central structural support is configured so that ground moisture is not permitted to reach an air conditioning unit positioned atop said pad when said pad is placed upon the ground.

16. The method of claim 11 wherein said pad further comprises overfill protection means adapted for leaving a void within said hollow interior chamber that can be used for fluid expansion when said pad is subjected to temperature extremes.

17. The method of claim 15 wherein said overfill protection means is selected from a group consisting of a fill line on said main body and a drain/vent opening located through said main body in a position to prevent overfill.

18. The method of claim 11 wherein said main body has a vertically extending surface and further wherein said at least one opening adapted for fill/vent/drain purposes comprises a main fill/vent/drain opening and a secondary vent opening through said vertically extending surface.

19. The method of claim 18 wherein said at least one opening adapted for fill/vent/drain purposes further comprises a secondary drain opening through said vertically extending surface.

20. The method of claim 11 wherein said wherein said main body has a vertically extending surface and further wherein said at least one opening adapted for fill/vent/drain purposes comprises a main fill/vent/drain opening and a secondary drain opening through said vertically extending surface.

* * * * *